US007834772B2

(12) United States Patent
Frederick

(10) Patent No.: US 7,834,772 B2
(45) Date of Patent: Nov. 16, 2010

(54) COPPER-WATCHER

(76) Inventor: Robert W. Frederick, P.O. Box 210604, Bedford, TX (US) 76095

( * ) Notice: Subject to any disclaimer, the term of this patent is extended or adjusted under 35 U.S.C. 154(b) by 330 days.

(21) Appl. No.: 12/098,422

(22) Filed: Apr. 5, 2008

(65) Prior Publication Data

US 2009/0251324 A1 Oct. 8, 2009

(51) Int. Cl.
*G08B 21/00* (2006.01)
*F25B 49/00* (2006.01)
*G01K 13/00* (2006.01)

(52) U.S. Cl. ..... 340/626; 340/611; 62/127; 62/129

(58) Field of Classification Search ..... 62/125, 62/127, 129–131; 340/603, 611, 626
See application file for complete search history.

(56) References Cited

U.S. PATENT DOCUMENTS 5,508,568 A * 4/1996 Mammen ..... 307/117
6,738,645 B2 * 5/2004 Knight ..... 455/561
2002/0154001 A1 * 10/2002 Tan et al. ..... 340/310.05
2003/0201892 A1 * 10/2003 Chance et al. ..... 340/568.2
2009/0077984 A1 * 3/2009 Tidrick ..... 62/129
2009/0160661 A1 * 6/2009 Hardin ..... 340/603

* cited by examiner

*Primary Examiner*—Jennifer Mehmood
(74) *Attorney, Agent, or Firm*—Wilson Daniel Swayze, Jr.

(57) ABSTRACT

A monitoring system for monitoring an air-conditioner may include a pressure sensor for detecting the pressure of the fluid of the air-conditioner, a power sensor for detecting the presence of supply voltage supplied to the air-conditioner and applied voltage which is applied to the air-conditioner, an activation device to activate an alarm based upon the detection of the pressure from the pressure sensor, the detection of the supply voltage to the air-conditioner and the detection of the applied voltage to the air-conditioner. The activation device may be activated based only on the loss of pressure detected by the pressure sensor, and the activation device may not be activated if the supplied voltage is detected. The activation device may be activated when both the supplied voltage is detected and the applied voltage is not detected, and the activation device may be connected to a disconnect switch to detect the supplied voltage. The activation device may include a first match resistor to complete a closed loop circuit to the alarm system, and the activation device may include a second match resistor which is approximately the same impedance as the first match resistor.

12 Claims, 2 Drawing Sheets

COPPER-WATCHER

FIELD OF THE INVENTION

The present invention relates to alarm systems and more particularly to a alarm system for a air-conditioning system.

BACKGROUND

Over the past several years, the price of commodities has steadily increased. Along with these commodities, the price of copper has risen significantly. This rise in the price of copper has made the theft of the copper an increasingly attractive target. Electric copper wire has been stripped from poles. Another rich source of copper is the air conditioner which uses the copper to transfer the heat from the cooling fluid to the atmosphere. The tubing of the air conditioner and fins are attractive target for thieves. Typically, the air conditioner is located outside on the ground level with little or no protection. Placing the air conditioner on the roof of a building has not act as a deterrent for the thieves. The use of cameras has provided some deterrence but usually merely provides a picture of the thieves which may cover their faces in order to hide their identity. What is required is a device that will aid police in catching these thieves, and place these thieves in jail.

Inventors have in the past sought solutions to the above problems. U.S. Pat. No. 3,544,722 by C. Hartfield et al., issued Dec. 1, 1970 entitled Security System describes a general alarm system for summoning assistance in response to a plurality of mishaps, such as break-in, fire, cold storage failure and so forth in response to sensors.

U.S. Pat. No. 3,441,929 by W. E. Coffer et al issued Apr. 29, 1969 entitled Remote Reporting System describes a general alarm system for reporting burglary, fire, refrigeration failure, etc. It depends on signalling a dedicated receiving station and indicate the different conditions by means of signals generated by motor driven cams.

U.S. Pat. No. 4,028,688 by J. B. Goleman issued Jun. 7, 1977, entitled Refrigeration Unit Air Temperature Detection Alarm System describes a refrigeration alarm system comprising temperature sensors, automatic telephone dialer and recorded message announcer. It also describes the use of a wireless radio connection between freezer compartments and the alarm system.

U.S. Pat. No. 4,146,886 by S. W. Timblin issued Mar. 27, 1979 entitled Freezer Alarm With Extended Life describes a freezer alarm device for locally indicating a freezer malfunction. It has no remote reporting capability.

U.S. Pat. No. 4,278,841 by Regennitter et al., issued Jul. 14, 1981, entitled Multiple Station Temperature Alarm System describes a freezer monitor system with wireless radio connection between the freezer compartments and the alarm system. The invention also describes an automatic telephone dialer combined with a recorded message circuit to deliver a message when the call is answered.

Numerous innovations for an electronic refrigeration and air conditioner monitor and alarm system have been provided in the prior art that are described as follows. Even though these innovations may be suitable for the specific individual purposes to which they address, they differ from the present invention as hereinafter contrasted.

U.S. Pat. No. 5,262,758

System and Method for Monitoring Temperature

Young K. Nam

A temperature monitoring system comprises a sensor for measuring the surrounding temperature, a timer for generating clock data, a controller for reading temperatures at predetermined intervals and storing selected temperature data and corresponding time data in memory, input switches for entering commands and data, a data display, and first and second alarm indicators. The controller operates in predetermined steps to activate the first alarm to indicate a current alarm condition and to activate the second alarm to indicate a past alarm condition. The controller selectively switches the display between normal and alarm modes to show differing time and temperature data depending on the temperature conditions monitored.

U.S. Pat. No. 5,136,281

Monitor for Remote Alarm Transmission

James P. Bonaquist

A remote monitoring apparatus comprises a computer program controlled monitor for detecting changes in condition responsive relay switches to generate a data signal identifying the change of switch condition, a report assembler which prepares a report in a preselected format identifying the apparatus location and including the data signal generated, and a modem for automatically transmitting the assembled report to a selected number of remote locations connected with the monitoring site by a telecommunication network. The monitoring apparatus repeatedly accesses the telecommunication network until a successful communication has been transmitted to each remote location. The apparatus also senses the loss of a continuous, primary power source and includes a back-up power supply. The program limits the number of unsuccessful attempts which can be made with the back-up power supply and preserves the assembled reports for later transmission when power has been fully restored. In addition, the remote locations to be contacted can be changed as desired, the format of the reports can be adjusted and the normal and alarm conditions of the relay switches can be adjusted as desired to increase the versatility of the monitoring device.

U.S. Pat. No. 5,008,655

Visual Alarm Device Interconnectable to Existing Monitoring Circuitry

Robert A. Schlesinger, Kimuel L. Hill, Hamid S. Ali, and Mark E. Watson

A visual alarm device monitors the condition of a control and indication circuit and gives a distinct visual alarm upon detection of an abnormal condition in the monitored circuit. The device uses the indicator lights of the monitored circuit itself to give the visual alarm. The alarm device interconnects with the monitored circuit locally requiring no new cabling and remains in a passive state until an abnormal condition is detected. When the monitored circuit is rendered inoperative by a thermal overload trip, the alarm device becomes active to flash the indicator lights to provide a distinct visual alarm. Included in the device is a test switch, an appropriate voltage converter, an oscillator, and a power indication light.

U.S. Pat. No. 4,882,564

Remote Temperature Monitoring System

Paul Monroe and James Kurth

A remote temperature sensing and warning system for a temperature controlled vehicle comprising a remote temperature controlled vehicle comprising a remote temperature sensing unit for measuring the temperature in the transport container and transmitting the temperature signal within a repeating time frame through the existing vehicle wiring to a remote receiver; the receiver decoding and converting the signal into a displayable form to continuously display the current temperature of the transport container; the receiver further detecting out of range temperatures and signal transmission errors and providing visual and aural alarms therefrom.

U.S. Pat. No. 4,675,654

Alarm Monitoring Device

Bobby E. Copeland

An alarm monitoring system which simultaneously provides a bright alarm light and audible alarm upon the occurrence of an abnormal condition in a function being monitored. The alarm light is reduced to a dim illumination upon acknowledging of the alarm condition by the operator and the audible alarm is also deactivated. The dimmed alarm indication reduces detrimental effect of night vision while maintaining notice of an abnormal condition.

Upon acknowledging the alarm condition, an electro-mechanical relay having two normally closed contacts and one normally opened contact is energized to redirect current flow to the alarm indicator lamp through a resistor and cause the dimmed illumination of the indicator lamp. A plurality of alarm indicator circuits are connected in parallel and have diodes connected in the circuitry to prevent electrical feedback in the system from causing false alarm indications in the corresponding alarm circuits. A test switch is provided which allows trouble shooting of the apparatus while the system is in normal use or out of use.

U.S. Pat. No. 4,644,478

Monitoring and Alarm System for Custom Applications

Lawrence K. Stephens and Robert B. Hayes

A monitoring and alarm system of general purpose design can be customized for use with many different applications to provide sophisticated alarming and control functions based on logical relationships among several sensed variables. A central processing unit is connected to receive a plurality of inputs from various sensors, the variety and type of which are the choice of the user depending on the specific application to which the monitoring and alarm system is to be connected. The central processing unit is programmed to provide the user with an interactive display to first define the variables in the application and the states and/or limits of the variables. This action defines a logical group. Next, the user enters the alarm/action functions to be performed on the condition that all the conditions in the logical group are true. Once this interactive process has been completed, the central processing unit performs the alarm and control functions specified by the user.

U.S. Pat. No. 4,612,775

Refrigeration Monitor and Alarm System

Michael A. Branz and Paul F. Renuad

A refrigerant monitor and alarm includes a sensor positioned to detect the level of liquid state refrigerant in the system and provide an electrical output signal therefrom, a digital display for displaying the refrigerant level, a circuit coupling the digital display to the sensor for actuating the digital display, and a heat reclaim system lockout circuit coupled to the sensor. In a preferred embodiment, the level display is a bar-graph LED-type display incorporated on a control panel also including a refrigerant level alarm and other parameter alarms.

U.S. Pat. No. 4,612,537

Alarm System for Monitoring the Temperature of a Liquid Contained in a Reservoir Andre Maltais and Andre Nadeau An alarm system and method for monitoring the temperature of a liquid contained in a reservoir. The system comprises a temperature sensing probe for sensing the temperature of the liquid. A sensing circuit is associated with the probe to generate a temperature indicating signal representative of the liquid temperature. A calibration circuit is provided for calibrating the temperature signal relative to a reference signal. Converter means is provided to convert the calibrated temperature signal to a binary signal indicative of sensed temperatures of the liquid whereby to feed comparator circuits having preset limit detectors to initiate an alarm signal when the temperature signal exceeds a predetermined value. The comparator circuits also feed a display device to indicate the temperature of the liquid.

U.S. Pat. No. 4,588,987

Display System for Monitoring and Alarm System

Lawrence K. Stephens

A display system is provided for a monitoring and alarm system. The monitoring and alarm system includes a central processing unit and a plurality of sensors polled by the central processing unit. A display which is part of the central processing unit is used to prompt user inputs to group a plurality of the sensed variables and the states and limits of each of the variables in a group. The display system is employed by the user to generate a schematic display of the system or environment being monitored. In the process of generating the schematic display, the user links alarm areas on the schematic display with a group or single variable defined by the user. In addition, the user links message areas on the schematic display with user defined messages to be displayed in the event all the conditions defined by the states and limits of variables in a group are true. After each schematic has been generated, it is stored together with the data defining the linked areas of the display. A stored schematic display may then be invoked, and once invoked, messages and status conditions are displayed in response to the sensed conditions of groups of variables sensed by said monitoring and alarm system.

U.S. Pat. No. 4,583,682

Air Conditioning Monitoring Device

Orlando Hernandez

An electric device for monitoring the usage of equipment that is being shared by one or more entities or individuals during a predetermined schedule and that needs to be made available to any one of these entities or individuals outside that schedule. The device includes timing means programmable for any schedule and capable of activating complementary relays, one of them a normally open and the other one a normally closed. The contacts of one of these relays are connected to a suitable point in the equipment being shared so that its operation may be interrupted or turned on. A plurality of second relay means, one associated with each one of the entities, are also connected to that point in the equipment so that each entity may be able to connect the equipment. Also, there is an elapsed time meter associated with each one of those second relay means so that the time that the equipment is used, outside the predetermined schedule can be tracked.

U.S. Pat. No. 4,553,400

Refrigeration Monitor and Alarm System

Michael A. Branz

A refrigerant monitor and alarm includes a sensor positioned to detect the level of liquid state refrigerant in the system and provide an electrical output signal therefrom, a digital display for displaying the refrigerant level, and a circuit coupling the digital display to the sensor for actuating the digital display. In a preferred embodiment, the level display is a bar-graph LED-type display incorporated on a control panel also including a refrigerant level alarm and other parameter alarms.

U.S. Pat. No. 4,482,785

Refrigeration Monitor System with Remote Signalling of Alarm Indications

Christopher D. Finnegan and Arthur J. Geiss

A refrigeration monitor system for monitoring an unattended freezer installation having a number of freezer compartments containing perishable products. The system comprises a network of temperature sensors located in the freezer compartments and connected to a common control which is connected to one or more telephone lines. The common control is capable of dialing in sequence any one of a group of selected alarm numbers. The person answering the alarm call receives a recorded message and must return a preselected answer code that is received by the system, and which stops the system from sending more alarm calls. The system continues to dial alarm numbers until it receives a satisfactory answer code. As a further safety measure the system, upon initiating an alarm, sets an alarm status indicator that must be manually reset within a preset time by the person attending to the freezer installation in response to the alarm, or else a new alarm sequence is automatically initiated.

U.S. Pat. No. 4,384,282

Device for Indicating a Freezing Temperature in a Selected Location

Everett G. Dennison, Jr.

The disclosed device comprises a pair of electrical conductors positioned in an elongated flexible insulating member and enclosed in an elongated tubular member which is filled with water or an aqueous solution having a known freezing temperature. The tubular member is sealed at its ends with the electrical conductors in their insulating member extending outwardly of one of the sealed ends and is connected with an alarm actuating circuit. A portion of the insulating member is removed from one of the pair of electrical conductors adjacent one end of the same within the tubular member and a portion of the insulating member is removed from the other one of the pair of electrical conductors adjacent the opposite end thereof so that an electrical circuit is completed through the water or aqueous solution in the elongated tubular member and interrupted when the water or aqueous solution freezes.

U.S. Pat. No. 4,256,258

Temperature Monitor and Alarm System

George W. Sekiya

The disclosed temperature monitoring and alarm circuit includes a temperature responsive switch which opens when water temperature exceeds a predetermined point. When the switch opens, a relay is de-energized, thereby activating a latch which activates a visual alarm and closes off a solenoid operated valve on the monitored water source until the over temperature condition is corrected and the circuit is reset.

U.S. Pat. No. 4,024,495

Remote Temperature Change Warning System

Frank J. O'Brien

The disclosed remote temperature change warning system comprises a temperature sensing circuit located in the refrigeration compartment of the refrigeration vehicle and a detection circuit located on the vehicle remote from the temperature sensing circuit and having means for indicating to the vehicle operator the temperature condition in the refrigeration compartment, the output of the temperature sensing circuit and the input of the remote detection circuit being electrically connected through the existing electrical wiring of the refrigeration vehicle.

U.S. Pat. No. 3,753,259

Cooler and Freezer Failure Warning System

Raymond L. Donovan

The disclosed cooler and freezer failure warning System includes a source of a rectified, pulsating, supply signal, a source of a lower regulated signal supplied by the supply signal source, a temperature sensor installed in a selected location a food case and responsively variable in resistance according to its sensed temperature, means responsive to the sensor resistance for producing a switch signal a predetermined over temperature condition, means responsive to the switch signal for producing a delayed switch signal, a temperature alarm device, and an alarm switch responsive to the delayed switch signal for applying the supply signal to energize the temperature alarm device. The warning system further includes fail-safe provisions for producing an alarm in the event of sensor failure. A power failure alarm device responsive to a loss of the regulated signal can also be included in the warning system.

U.S. Pat. No. 2,994,858

System for Signalling Failure of Refrigeration Devices

William E. Coffer

The disclosed signal system provides warning signals when dangerously high temperature conditions exist in any of a group of cold storage cabinets. This system is a high temperature detection and alarm system for a group of refrigeration units. This system comprises a sensing circuit including a plurality of normally open thermostatic switches each disposed within one of a group of refrigeration units and is adapted to close when the temperature in any of the units exceeds a predetermined maximum temperature. Several signal devices are arranged in series with these thermostatic switches and are adapted to emit a warning signal when the switch in series with it is closed.

Johnson Controls recently manufactured a device which has an optical sensor to view bubbles or refrigerant conditions in the lines by means of a sight glass. A sight glass is a fitting equipped with a transparent window, usually at both the top and bottom of the fitting, to allow the service persons to actually view the condition of the refrigerant. The optical sensing device would only be instrumental in detecting refrigerant related problems on systems so equipped.

Paragon Electric Company, Inc. of Two Rivers, Wis. manufactures a device which also addresses the same preventive maintenance concerns. This device performs its function by analyzing the current draw on large, commercial systems and correlates that information with a variety of possible system problems. Its sole application is with very large, commercial air-conditioning and refrigeration systems.

Numerous innovations for an electronic refrigeration and air conditioner monitor and alarm system have been provided in the prior art that are adapted to be used. Even though these innovations may be suitable for the specific individual purposes which they address, they would not be suitable for the purposes of the present invention as heretofore described.

U.S. Pat. No. 5,684,463 discloses an electronic refrigeration and air conditioner monitor and alarm system for monitoring air conditioning and refrigeration systems for inefficiencies that waste energy. The device monitors and analyzes the temperatures of the suction line of such systems for variances that indicate malfunctions or abnormal operation of the system. The device provides both an audible and visual alert to warn the end user that the equipment is in need of maintenance and/or repair.

U.S. Pat. No. 5,260,691 discloses a combination fire alarm/air conditioner, which can immediately detect a fire. The device includes a temperature-sensor and/or a smoke-sensor installed in the room-side air inlet of the air conditioner. Signals generated by the sensor are received by a microcomputer which monitors them based on a threshold and a rate of change of the signals. When the rate of change of the signals exceeds the threshold, the microcomputer produces signals which set off an alarm.

U.S. Pat. No. 4,937,559 discloses an air conditioner drain blockage alarm system which is designed for application to both horizontally and vertically-mounted heating and air conditioning units, which alarm includes in a preferred embodiment, both a normally open drain line liquid level switch and a normally closed drain pan liquid level switch for sensing blockage of a drain line in both the drain line itself and in the condensate drain pan which collects condensate from the air conditioning unit. In addition to the drain line and drain pan liquid level switches, the system is characterized by an alarm which audibly indicates a high water condition in either the condensate drain pan or the drain line and a manual override switch for manually silencing the alarm. In a preferred embodiment, the system is wired through the existing thermostat in the heating and air conditioning unit to facilitate deactivating the air conditioning system by the drain pan liquid level switch when the condensate drain pan is subject to overflow.

SUMMARY

A monitoring system for monitoring an air-conditioner may include a pressure sensor for detecting the pressure of the fluid of the air-conditioner, a power sensor for detecting the presence of supply voltage supplied to the air-conditioner and applied voltage which is applied to the air-conditioner, an activation device to activate an alarm based upon the detection of the pressure from the pressure sensor, the detection of the supply voltage to the air-conditioner and the detection of the applied voltage to the air-conditioner.

The activation device may be activated based only on the loss of pressure detected by the pressure sensor, and the activation device may not be activated if the supplied voltage is not detected.

The activation device may be activated when both the supplied voltage is detected and the applied voltage is not detected, and the activation device may be connected to a disconnect switch to detect the supplied voltage. The activation device may include a first match resistor complete the circuit from the connected alarm system, and the activation device may include a second match resistor which is approximately the same impedance as the first match resistor.

The activation device may include a first relay, and the activation device may include a second relay.

The pressure sensor may be connected to input/output coolant line, and the air-conditioner may include a motor.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

The copper-watcher is a monitoring system that monitors both voltage and fluid pressure in order to detect open circuit in wiring of a monitored device which may be an air conditioning system. The monitoring system of the present invention connects directly by being wired or indirectly by being wirelessly connected to a security system. When one of the sensors of the monitoring system provides an indication that communication has been lost to the alarm system, the alarm system is activated to indicate that a thief may be attempting to steal copper from the air conditioner. The alarm system may be a stand-alone alarm system, an alarm system with an automatic dialer or a monitored alarm system. The copper-watcher has two applications in which one is an antitheft system and the other is an equipment safety monitor. If the supplied power to the connection box has failed, no alarm is activated. If the supplied power remains on and the power to the air conditioner fails, then the alarm is sounded. If the pressure within the coil of the air conditioner drops below a predetermined level, then an alarm is sounded. The monitoring capability of the present invention can be expanded. For example a series of pressure sensors or temperature sensors with differing trip points for example high and low could be used with the present invention to provide an enhanced capability. If the system detects above or below a desired pressure or temperature or if the voltage drops below a predetermined point, a relay is opened to activate the alarm system, and the monitoring company is called. The present invention can be extended to three-phase equipment by which each phase would have an independent voltage detector.

Figure 1:
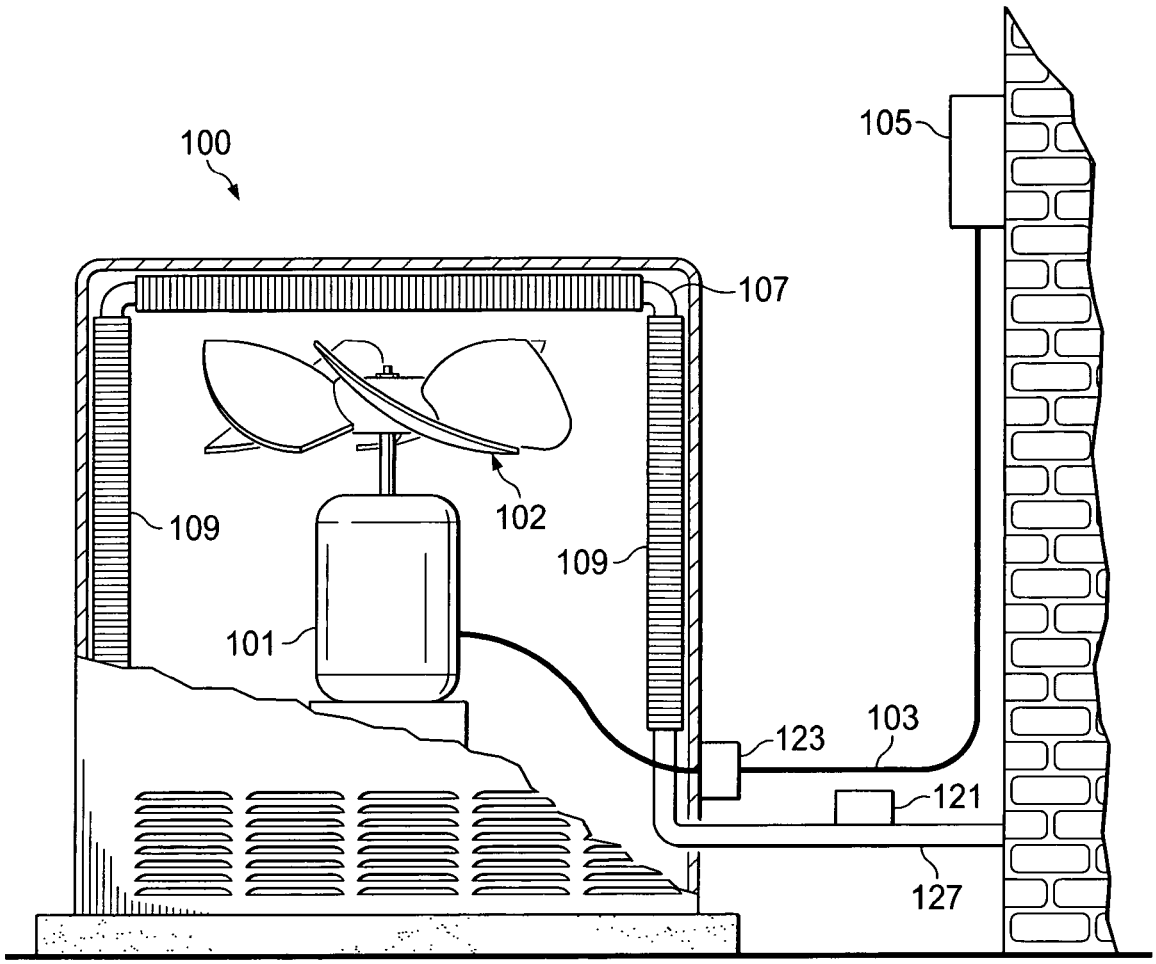
FIG. 1 illustrates a cross-sectional view of a monitoring system of the present invention.

FIG. 1 illustrates an air conditioner alarm system 100 in accordance with the teachings of the present invention. The air conditioner alarm system 100 includes a motor 101 to drive a fan 102 to provide air circulation to the air conditioner. FIG. 1 illustrates a disconnect switch 105 to disconnect electric power supply to the air conditioner and to the air conditioner alarm system 100. FIG. 1 additionally illustrates an input/output coolant line 127 to supply/return coolant fluid to and from the air conditioner. The input/output coolant line 127 is pressurized with coolant fluid and the pressure is measured by the pressure sensor 121. The coolant fluid flows through the coolant tubing 107 which is connected to cooling fins 109 to aid in the cooling of the coolant tubing 107.

Figure 2:
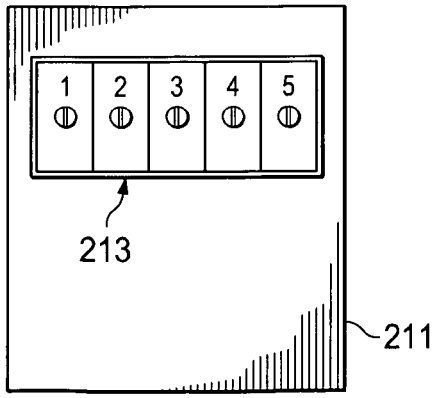
FIG. 2 illustrates a control box of the present invention.

FIG. 2 illustrates a control box 211 for an alarm system which includes input terminals 213 which when activated result in an alarm which may include an audio alarm and contacting a monitoring service to dispatch the proper authorities.

Figure 3:
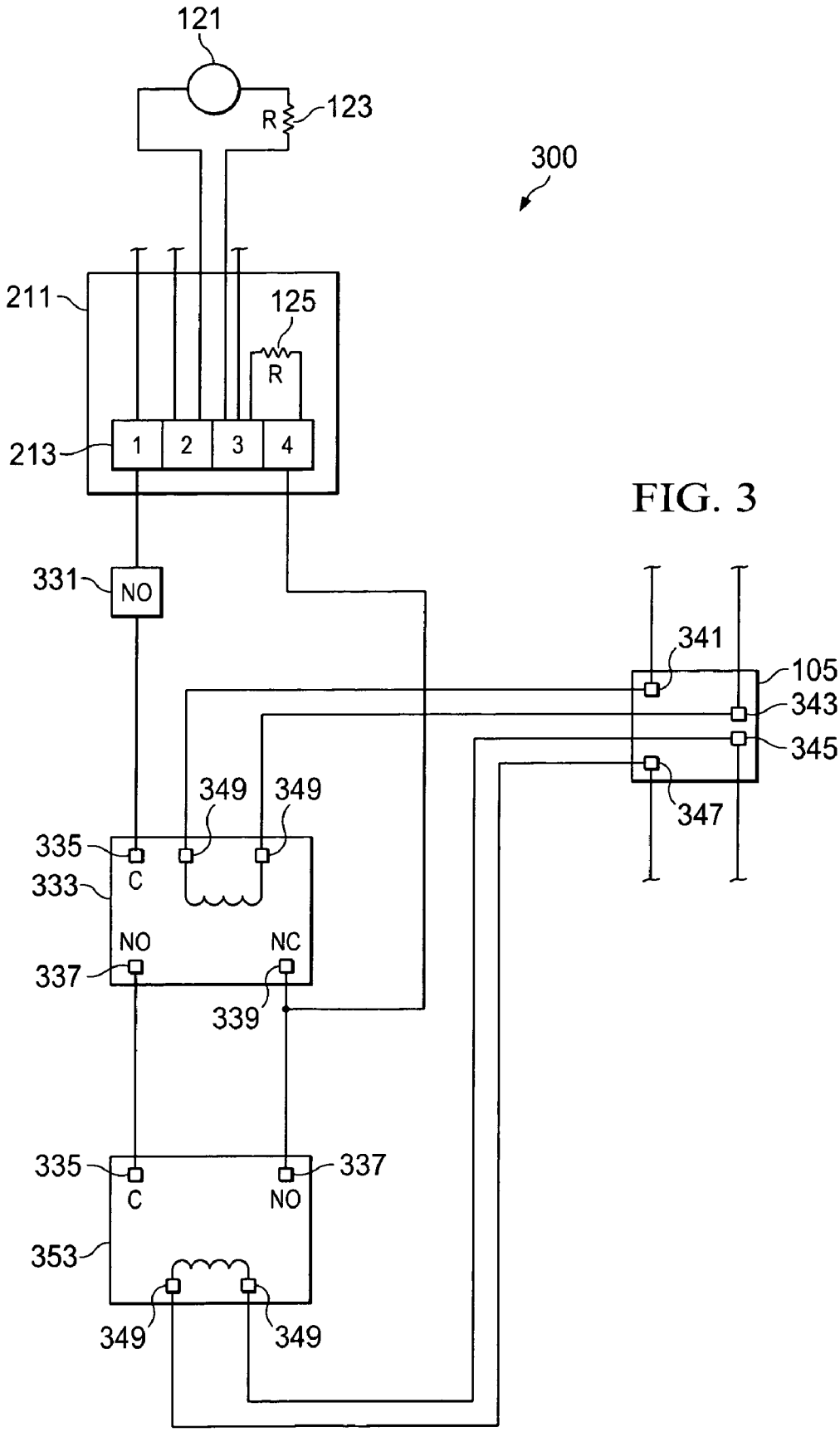
FIG. 3 illustrates the electronics of an activation device.

FIG. 3 illustrates the electronics of an activation device 300 of the alarm system 100 of the present invention. FIG. 3 illustrates the disconnect switch 105 which includes a first disconnect terminal 341 and a second disconnect terminal 343 which connects to the supplied power and also connects to the first and second input terminal 349 of the first relay 333. The disconnect switch 105 includes a third disconnect terminal 345 and a fourth disconnect terminal 347 which connect to the input terminal 349 of the second relay 353. The common terminal 335 of the second relay 353 is connected to the normally open terminal 337 of the first relay 333 and the normally open terminal 337 of the second relay 353 is connected to the normally closed terminal 339 of the first relay 333. Additionally, the normally closed terminal 339 is connected to the fourth terminal of the control box 211. The common terminal 335 of the first relay 333 is connected to a normally open switch 331 which is connected to the first terminal of the control box 211. The pressure sensor 121 is connected to the second terminal of the control box 211 and the pressure sensor 121 is connected to the first matching resistor 123 which is connected to the third terminal of the control box 211. A second matching resistor 125 which matches the first matching resistor 123 is connected between the third and fourth terminal of the control box 211. Consequently, when the pressure sensor 121 detects a low pressure within the input output coolant line 127, the alarm is activated through the control box 211 and when the second relay 353 detects a loss of voltage, the alarm is activated through the control box 211. The alarm is activated through the control box 211 as long as the supplied power is being supplied to the disconnect switch 105.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A monitoring system for monitoring an air-conditioner; comprising:

a pressure sensor for detecting the pressure of the fluid of the air-conditioner;

a power sensor for detecting the presence of supply voltage supplied to the air-conditioner and applied voltage which is applied to the air-conditioner;

an activation device to activate an alarm based upon the detection of the pressure from the pressure sensor, the detection of the supply voltage to the air-conditioner and the detection of the applied voltage to the air-conditioner, wherein the activation device is not activated if the supplied voltage is not detected.

2. A monitoring system for monitoring an air-conditioner as in claim 1, wherein the activation device is activated based only on the loss of pressure detected by the pressure sensor.

3. A monitoring system for monitoring an air-conditioner as in claim 1, wherein the activation device is activated when both the supplied voltage is detected and the applied voltage is not detected.

4. A monitoring system for monitoring an air-conditioner as in claim 1, wherein the activation device is connected to a disconnect switch to detect the supplied voltage.

5. A monitoring system for monitoring an air-conditioner as in claim 1, wherein the activation device includes a first match resistor to complete a closed loop circuit to the alarm system.

6. A monitoring system for monitoring an air-conditioner as in claim 1, wherein the activation device includes a second match resistor which is approximately the same impedance as the first match resistor.

7. A monitoring system for monitoring an air-conditioner as in claim 1, wherein the activation device includes a first relay to complete a closed loop circuit to the alarm system.

8. A monitoring system for monitoring an air-conditioner as in claim 1, wherein the activation device includes a second relay.

9. A monitoring system for monitoring an air-conditioner as in claim 1, wherein the pressure sensor is connected to input/output coolant line.

10. A monitoring system for monitoring an air-conditioner as in claim 1, wherein the air-conditioner includes a motor.

11. A monitoring system for monitoring an air-conditioner as in claim 1, wherein the air-conditioner includes coolant tubing.

12. A monitoring system for monitoring an air-conditioner as in claim 1, wherein the air-conditioner includes cooling fins.

* * * * *